US005417456A

United States Patent [19]

Laubacher

[11] Patent Number: 5,417,456

[45] Date of Patent: May 23, 1995

[54] FOLDER HOLDER

[75] Inventor: Morgan K. Laubacher, Canoga Park, Calif.

[73] Assignee: The Folder Holder Partnership, Thousand Oaks, Calif.

[21] Appl. No.: 21,023

[22] Filed: Feb. 23, 1993

[51] Int. Cl.[6] ..... B42D 3/00

[52] U.S. Cl. ..... 281/45; 281/43; 281/36; 402/4; 402/80 R

[58] Field of Search ..... 281/42, 45, 31, 36, 281/29, 43; 402/4, 80 R; 206/472

[56] References Cited

U.S. PATENT DOCUMENTS 273,886 3/1883 Pester .
510,161 12/1893 Clancy .
897,332 9/1908 Wilson .
1,519,610 12/1924 Franz, Jr. .
1,786,504 12/1930 Parrish .
2,270,213 1/1942 Deusch .
2,786,281 3/1957 Kramer et al. .
4,108,473 8/1978 Coen .
4,593,934 6/1986 Lehman ..... 281/45
4,874,340 10/1989 Smallwood .
4,988,229 1/1991 Ramsey, III ..... 281/45 X
5,037,136 8/1991 McIntire .
5,120,149 6/1992 Smith .
5,222,765 6/1993 Pilessi ..... 281/45 X

*Primary Examiner*—Willmon Fridie
*Attorney, Agent, or Firm*—Thomas I. Rozsa; Tony D. Chen

[57] ABSTRACT

The present invention is a folder holder. It is utilized with books or similar articles designed to be retained in a hand of an individual. The present invention folder holder is utilized in either hand depending on the individual preference.

76 Claims, 2 Drawing Sheets

Fig. 1.
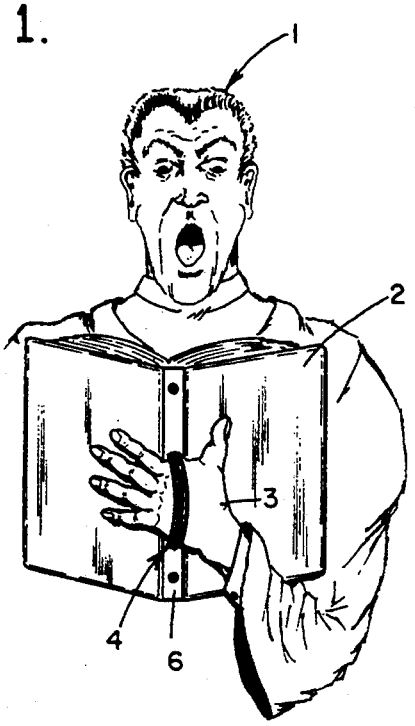
Fig. 2.
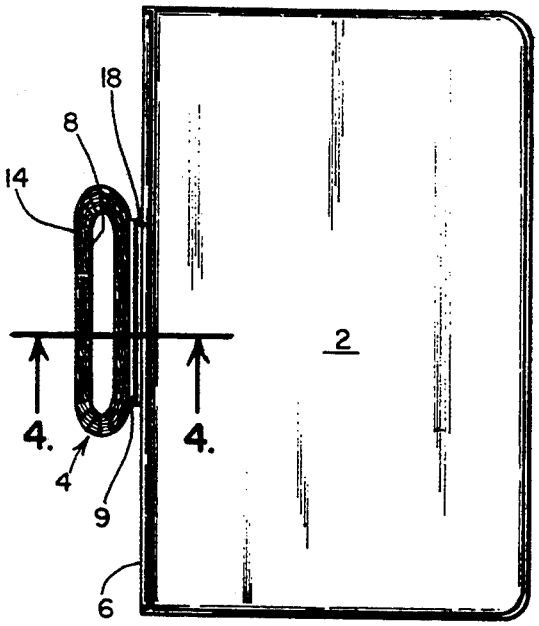
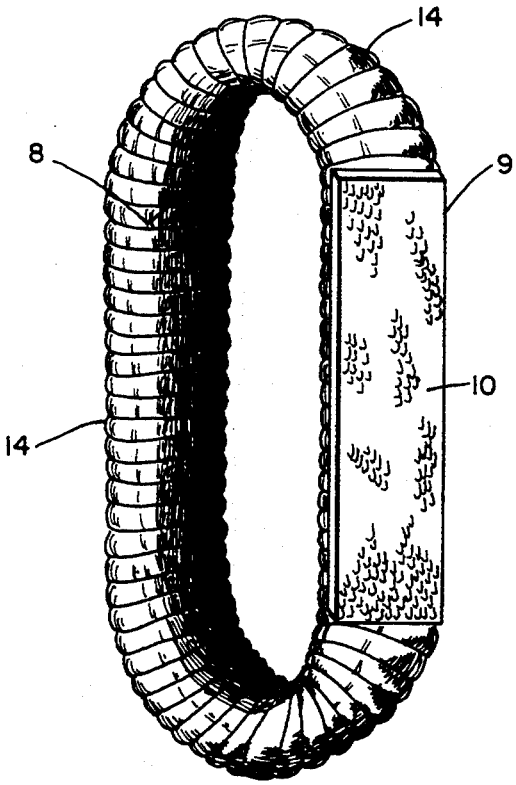
Fig. 3.
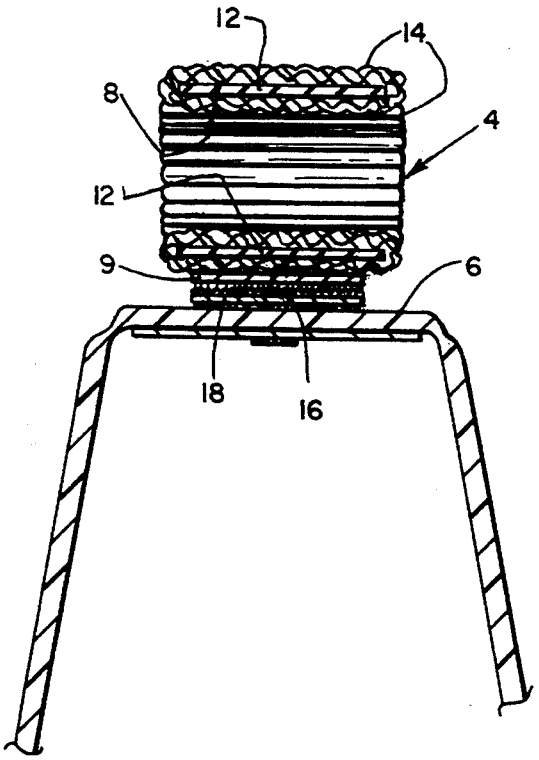
Fig. 4.

FOLDER HOLDER

BACKGROUND OF THE INVENTION

1. Field of the Invention

The present invention relates to a folder or notebook. In particular, the present invention relates to a device for comfortably holding a folder for an extended period of time.

2. Description of the Prior Art

Various devices for holding a folder or a book are known in the prior art. Generally, such devices are utilized to carry books from place to place. Other devices are utilized for holding books. The disadvantage with some of these devices is that they are designed for a left hand, as discussed in the Wilson Patent. Another disadvantage is that the straps utilized in these devices have no absorbent material for absorbing the perspiration off the hand. The following prior art references are relevant to the field of the present invention.

1. U.S. Pat. No. 5,120,149 issued to Smith on Jun. 9, 1992 for "Convertible Ring Binder Incorporating Exchangeable Covers And Ring Means" (hereafter "the Smith Patent").

2. U.S. Pat. No. 5,037,136 issued to McIntire on Aug. 6, 1991 for "Book Stiffener" (hereafter "the McIntire Patent").

3. U.S. Pat. No. 4,874,340 issued to Smallwood on Oct. 17, 1989 for "Combined Amusement Device And Transport And Storage Pack" (hereafter "the Smallwood Patent").

4. U.S. Pat. No. 4,108,473 issued to Coen et al. on Aug. 22, 1978 for "Perfect Bound Sample Book With Integral Handle" (hereafter "the Coen Patent").

5. U.S. Pat. No. 2,786,281 issued to Kramer et al. on Mar. 26, 1957 for "Binder For Textile Swatch" (hereafter "the Kramer Patent").

6. U.S. Pat. No. 2,270,213 issued to Deusch on Jan. 13, 1942 for "Bookholder And Carrier (Jacket)" (hereafter "the Deusch Patent").

7. U.S. Pat. No. 1,786,504 issued to Parrish on Dec. 30, 1930 for "Booklet Label" (hereafter "the Parrish Patent").

8. U.S. Pat. No. 1,519,610 issued to Franz, Jr. on Dec. 16, 1924 for "Binder" (hereafter "the Franz Patent").

9. U.S. Pat. No. 897,332 issued to Wilson on Sep. 1, 1908 for "Order Holder" (hereafter "the Wilson Patent").

10. U.S. Pat. No. 510,161 issued to Clancy on Dec. 5, 1893 for "Combined Book Clasp And Handle" (hereafter "the Clancy Patent").

11. U.S. Pat. No. 273,886 issued to Pester on Mar. 13, 1883 for "Book Holding Device" (hereafter "the Pester Patent").

The Smith Patent discloses a ring binder that incorporates exchangeable covers and a ring structure. It includes a front cover having a spine portion, a back cover having a spine portion, and a ring means. It utilizes hook and loop type structures to retain the front and back covers together. The hook and loop type structures are VELCRO-R.

The Parrish Patent discloses a label for identification purposes. The label is positioned around the back of a book cover which is retained in position by staples.

The Wilson Patent discloses an order-holder. It includes two flexible straps. The first strap member is designed to receive the fingers of the operator and the second strap member is designed to receive the thumb of the operator. The second strap member is secured at one end to the cover and having an enlargement at its opposite end with the free end of the strap passing loosely beneath a keeper, the enlargement thereby prevents the disengagement of the strap and the keeper. Similarly, the first strap member has enlargements at each end; with the ends of the strap passing loosely beneath the keepers. In this way, the enlargements prevent the disengagement of the strap and the keepers. The Wilson Patent is specifically designed to hold a book, and its attaching means which are permanently affixed means would require a fairly thick surface in order to support that attaching means. This is not practical for the thin folder that is used to hold the music for choir singers. Further, the attaching means are not along the spine of the book and the attaching means do not provide the flexibility of being able to hold a book in each hand for a portion of the time, which is a feature of the present invention.

The McIntire Patent discloses a book stiffener. It includes a relatively flat, thin, elongated, ridged, rotatable strip having a length dimension substantially greater than the width of a back binding of a book cover.

The Smallwood Patent discloses a combined children's amusement device and transport and storage pack. It includes first and second members having a central portion for joining the first and second members and a three dimensional object attached to a major surface of one of the members.

The Coen Patent discloses a perfect bound sample book. It has an internal spine directly connected to and binding the pages of the book.

The Kramer Patent discloses an assembly providing a binder for textile swatch. The binder includes two cover portions joined together by a spine, and a containing means which is detachable and secures the swatch to the binder.

The Deusch Patent discloses a bookholder and carrier. It is used to support a book by the jacket from the lower edges of the book covers and to draw the book covers together by the supporting means of the jacket.

The Franz Patent discloses a binder. It is a cover used to protect a book from dust and rain.

The Clancy Patent discloses a combined book clasp and handle. It includes a handle connected to the edge of one of the covers, and a clasp or yoke similarly connected with the opposite edge of the other cover.

The Pester Patent discloses a book holding device. The device is used for carrying books.

It will be desirable to have a way to hold a folder or notebook in an individual's hand for long periods of time without causing cramps in the hand. It is also desirable to have a way to absorb the perspiration from the hand while the individual is performing.

SUMMARY OF THE INVENTION

The present invention is a novel and unique folder holder. It is a comfortable elastic band covered in an absorbent terry cloth material which is designed to wrap around either hand of a user. One use of the present invention is for a choir singer to hold a music folder during a performance. In current practice, the choir singer holds the music folder between the thumb and fingers of one hand. After an extended period of time, cramps can develop in the hand and it becomes very tedious to hold the music folder. The present invention includes an elastic band which is wrapped in an absorbent material and includes a central opening to receive the fingers of a hand. The absorbent material absorbs perspiration from the hand. The elastic band covered by the absorbent material is removably attached to the spine of the music folder. In this way, the folder rests on the palm of the hand when the fingers are placed through the absorbent material. The folder resting in the palm of the hand is much more comfortable than holding the folder between the thumb and fingers. Therefore, cramps will not develop and the performer can sing more comfortably.

It is known that hook and loop type fasteners such as VELCRO-R male and female fasteners are widely utilized in many industry. The present invention utilizes VELCRO-R type male and female fasteners. A strip of VELCRO-R is sewn onto the bottom of the elastic band. In addition, the present invention includes a mating web having a VELCRO-R fastener on one side for affixing to the other VELCRO-R on the elastic band and an adhesive means on the web's other side for affixing it to the folder. In this way, the band can hold the folder through the mating of the hook and loop VELCRO-R members.

The principal advantage of this design is that by having a holder on the folder, it provides a performer with a comfortable way to hold the folder in either hand. In addition, the performer can hold the folder for long periods of time while performing, and cramps will not develop in the hand holding the folder.

It has been discovered, according to the present invention, that if the elastic band is covered with an absorbent terry cloth material, it will provide an absorbent material for absorbing the perspiration off the hand while holding a folder or a notebook for long periods of time.

It has further been discovered, according to the present invention, that by utilizing the male hook type and female loop type fasteners, it will provide a removably attachable device for maximum adjustability.

It is therefore an object of the present invention to provide a comfortable folder holder, so that it can be used for long periods of time without the hand cramping.

It is an additional object of the present invention to provide a device that utilizes the male hook type and female loop type fasteners, so that it can be removably attachable onto the folder for maximum adjustability.

It is a further object of the present invention to provide a device for holding the folder which is cost efficient to manufacture. Since, the VELCRO-R male or female fasteners are directly attached to the holder and the folder respectively without any additional supporting piece, the cost of manufacturing the folder holder will not be significantly increased.

In the preferred embodiment of the present invention, the folder holder is comprised of five constituent parts. First, there is a folder or a book cover with a stiff spine. Second, there is an elastic band. Third, there is a terry cloth wrapped around the elastic band. Fourth, there is a VELCRO-R female loop fastener affixed to the spine of the folder or book cover. Fifth, there is a VELCRO-R male hook fastener sewn onto the terry cloth. The male hook fastener can be attached to the female loop fastener, so that it can be removably attachable onto the spine of the folder or book cover for maximum adjustability. In this way, the holder can hold the folder or book cover through the mating of the hook and loop VELCRO-R members.

In alternative embodiment of the present invention, the folder holder is comprised of four constituent parts. First, there is a folder or book cover with a stiff spine. Second, there is an elastic band. Third, there is a VELCRO-R female loop fastener affixed to the spine of the folder or book cover. Fourth, there is a VELCRO-R male hook fastener sewn onto the elastic band. The male hook fastener can be attached to the female loop fastener, so that it can be removably attachable onto the spine of the folder or book cover for maximum adjustability. In this way, the holder can hold the folder or book cover through the mating of the hook and loop VELCRO-R members.

In another alternative embodiment of the present invention, the folder holder is comprised of four constituent parts. First, there is a folder or book cover with a stiff spine. Second, there is an elastic absorbent material. Third, there is a VELCRO-R female loop fastener affixed to the spine of the folder or book cover. Fourth, there is a VELCRO-R male hook fastener sewn onto the elastic absorbent material. The male hook fastener can be attached to the female loop fastener, so that it can be removably attachable onto the spine of the folder or book cover for maximum adjustability. In this way, the holder can hold the folder or book cover through the mating of the hook and loop VELCRO-R members.

In another alternative embodiment of the present invention, the folder holder is comprised of four constituent parts. First, there is a folder or book cover with a stiff spine. Second, there is an elastic or elasticized material shaped as a "C". Third, there is a VELCRO-R female loop fastener affixed to the spine of the folder or book cover. Fourth, there is a VELCRO-R male hook fastener with two end edges sewn onto the two end edges of the elasticized material. The male hook fastener can be attached to the female loop fastener, so that it can be removably attachable onto the spine of the folder or book cover for maximum adjustability. In this way, the holder can hold the folder or book cover through the mating of the hook and loop VELCRO-R members.

In the preferred embodiment and in each of the alternative embodiments, it is also within the spirit and scope of the present invention to have the VELCRO-R male hook fastener affixed to the spine of the folder or book cover and the VELCRO-R female loop fastener affixed to the terry cloth wrapped around the elastic band, to the elastic band, to the elastic absorbent material, and to the C-shaped elastic material.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the present invention folder holder utilized with an individual's hand.

FIG. 2 is a side view of the present invention folder holder attached to the stiff spine of the folder.

FIG. 3 is a perspective view of the elastic band covered with a terry cloth and the VELCRO-R sewn onto the terry cloth.

FIG. 4 is a cross-sectional view of the present invention folder holder, taken along 4—4 of FIG. 2.

DESCRIPTION OF THE PREFERRED EMBODIMENT

Figure 5:
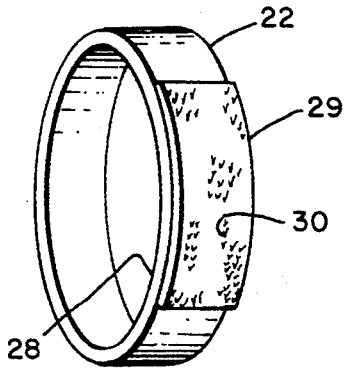
FIG. 5 is a perspective view of an alternative embodiment of the present invention holder with an elastic band and the VELCRO-R sewn onto the elastic band.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 and 2, there is shown an individual 1 with his hand 3 holding a folder 2 with the present invention folder holder 4. The folder holder 4 is removably attachable and is attached to the exterior surface of a stiff spine 6 of the folder 2. In operation, the hand 3 which is shown, is slid into the opening 8 of the folder holder 4. The folder 2 is retained by the holder 4 in which the hand 3 is positioned. The arms of the individual 1 also support the folder 2. By utilizing the present invention, cramps will not develop in the individual's hand will not cramp because of the way the folder 2 is retained. The present invention can be utilized with a left-handed person or a right-handed person.

It will be appreciated that the present invention is not limited to the stiff spine 6 of the folder 2 as described above. It is emphasized that while the spine 6 is the preferred location, it is also within the spirit and scope of the present invention to position the holder for maximum comfort. In addition, it will not be too hard for one skilled in the art to relocate the holder at another location.

Referring to FIGS. 2 and 4, there is shown at 4 the present invention folder holder. The folder holder 4 is attached to the stiff spine 6 of the folder 2. The elongated female fastener 18 is affixed by adhesive means onto the exterior surface of the stiff spine 6 and the elongated male fastener 9 is stitch onto the outer surface of the absorbent material 14.

The folder holder 4 can be attached by fastening the elongated male fastener 9 onto the elongated female fastener 18. The two mating surfaces of the two fasteners are engaged at 16. The folder holder 4 can also be detached from the stiff spine 6 of the folder 2 by pulling the fasteners apart.

Referring to FIGS. 3 and 4, there is shown the folder holder 4. The folder holder 4 consists of a comfortable circular elastic band 12 covered with an absorbent material such as terry cloth 14 or any type of fabric material and a hook (male) fastener 9 and loop (female) fastener 18. In the preferred embodiment, the elongated male and elongated female fasteners are made of hook or male and loop or female VELCRO-R fasteners. Each VELCRO-R fastener has a thin backing which has a front surface and an opposite back surface. There are usually no functional structures on the back surface of a VELCRO-R fastener. The functional mating surface of the VELCRO-R fastener is carried on its front surface. The front surface of a male fastener 9 is a hook type mating surface 10 which has a large amount of filamentary hook members, and the front surface of a female fastener 18 is a loop type mating surface which has a large amount of filamentary loop members. When the male and female VELCRO-R fasteners 9 and 18 are attached to the outer surface of the terry cloth 14 and the exterior surface the stiff spine 6 respectively, it is their non-functional back surfaces which are brought into contact with the outer surface of the terry cloth 14 and the exterior surface of the stiff spine 6 respectively. One of the preferred methods of attaching to the outer surface of the terry cloth 14 is stitching means. Also, the method of attaching to the stiff spine 6 is adhesive means. The stitching lines stitch the thin backing of the elongated male fastener 9 onto the designated surface of the terry cloth 14. The elongated female fastener 18 is affixed to the exterior surface of the stiff spine 6 by adhesive means onto the designated surface.

Referring to FIG. 5, there is shown an alternative embodiment of the folder holder. The folder holder consists of an elastic band 22 and a hook (male) fastener 29 with an opening 28 through which the individual's fingers are inserted. The front surface of a male fastener 29 is a hook type mating surface 30 which has a large amount of filamentary hook members. The male VELCRO-R fastener 29 is attached to the outer surface of the elastic band 22. The elongated female fastener is affixed to the exterior surface of the stiff spine of the folder or book cover by adhesive means onto the designated surface as described above in FIGS. 3 and 4. This alternative embodiment functions the same as described above.

Figure 6:
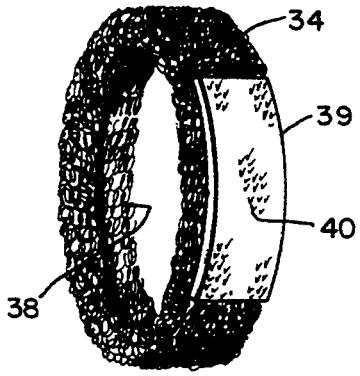
FIG. 6 is a perspective view of another alternative embodiment of the present invention holder with an elastic absorbent material and the VELCRO-R sewn onto the elastic absorbent material.

Referring to FIG. 6, there is shown another alternative embodiment of the folder holder. The folder holder consists of an elastic absorbent material 34 (such as the type of material from which sweat bands are made) and a hook (male) fastener 39 with an opening 38 through which the individual's fingers are inserted. The front surface of a male fastener 39 is a hook type mating surface 40 which has a large amount of filamentary hook members. The male VELCRO-R fastener 39 is attached to the outer surface of the absorbent material 34. The elongated female fastener is affixed to the exterior surface of the stiff spine of the folder or book cover by adhesive means onto the designated surface as described above in FIGS. 3 and 4. This alternative embodiment functions the same as described above.

Figure 7:
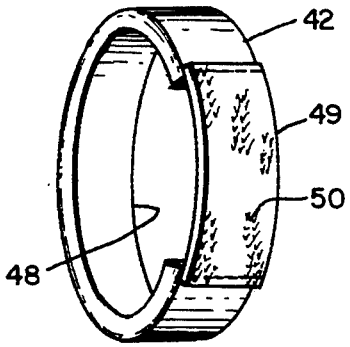
FIG. 7 is a perspective view of another alternative embodiment of the present invention holder with a "C" shaped elastic material and the VELCRO-R sewn on the ends of the elastic material.

Referring to FIG. 7, there is shown another alternative embodiment of the folder holder. The folder holder consists of a "C" shaped elastic material or band 42 and a hook (male) fastener 49 with an opening 48 through which the individual's fingers are inserted. The front surface of a male fastener 49 is a hook type mating surface 50 which has a large amount of filamentary hook members. The two ends of the male VELCRO-R fastener 49 are attached to the ends of the "C" shaped elastic material 42. The elongated female fastener is affixed to the exterior surface of the stiff spine of the folder or book cover by adhesive means onto the designated surface as described above in FIGS. 3 and 4. This alternative embodiment functions the same as described above.

Figure 9:
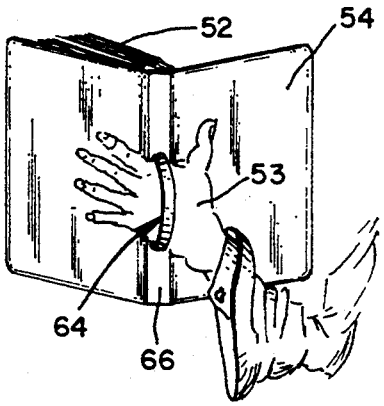
FIG. 9 is a perspective view of the present invention holder utilized with a book cover and an individual's hand.
Figure 8:
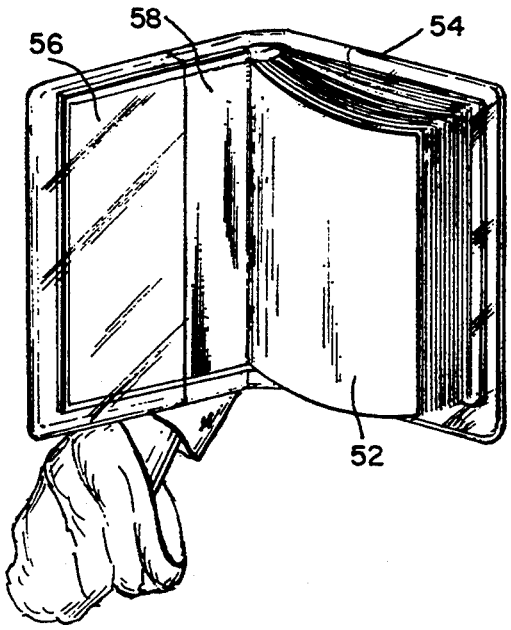
FIG. 8 is a perspective view a book cover covering a book.

Referring to FIGS. 8 and 9, there is shown another use of the folder holder 64. A hand 53 holding a book cover 54 with a book 52 inside the book cover 54. The folder holder 64 is removably attachable and is attached to the exterior surface of the spine 66 of a conventional book cover 54. The book cover 54 is similar to the folder as described above. The two ends of the book 52 are slipped into the two slot openings of the book cover 54 respectively. Only one end of the book 58 and one slot opening 56 is shown in FIG. 8. This alternative use functions the same as described above and both the preferred embodiment and the alternative embodiment of the present invention can be used with the book cover 54 instead of the holder.

It will be appreciated that although the present invention has been illustrated with the hook or male fastener attached to the material and the loop or female fastener attached to the spine of the folder or book cover, the reverse is also within the spirit and scope of the present invention. Therefore, the loop or female fastener can be attached to the material and the hook or male fastener can be attached to the spine of the folder or book cover.

The present invention has many advantageous features including: (a) it is removably attachable onto another mating surface; (b) it is inexpensive to manufacture; (c) it can be a towel for absorbing the perspiration from the user's hand; and (d) the elastic band can be wrapped with all types of absorbent material or without absorbent material.

Defined in detail, the present invention is a folder with a removably attachable holder, comprising: (a) a folder having a spine with an exterior surface and interior surface; (b) an elongated female fastener having a loop type mating surface; (c) means for attaching said elongated female fastener to said exterior surface of said spine and having said loop type mating surface facing away from said exterior surface of said spine; (d) an elastic band covered in a terry cloth which has an outer surface; (e) said elastic band having an interior opening to receive fingers of a hand; (f) an elongated male fastener having a complementary hook type mating surface for mating with said loop type mating surface of said elongated female fastener; and (g) means for attaching said elongated male fastener to said outer surface of said terry cloth and having said hook type mating surface facing away from said outer surface of said terry cloth; (h) whereby said complementary hook type mating surface of said elongated male fastener can be affixed to said loop type mating surface of said elongated female fastener to removably attach to said terry cloth to said spine of said folder, which forms said holder adapted to receive either hand of a user.

Defined broadly, the present invention is a holder for a folder having a spine with an exterior surface, comprising: (a) a first elongated fastener having a mating surface; (b) means for attaching said first elongated fastener to said exterior surface of said spine and having said mating surface facing away from said exterior surface of said spine; (c) an elastic band covered by an absorbent material which has an outer surface; (d) said elastic band having an interior opening to receive fingers of a hand; (e) a second elongated fastener having a complementary mating surface for mating with said mating surface of said first elongated fastener; and (f) means for attaching said second elongated fastener to said outer surface of said absorbent material and having said mating surface facing away from said outer surface of said absorbent material; (g) whereby said complementary mating surface of said second elongated fastener can be affixed to said mating surface of said first elongated fastener to removably attach to said absorbent material to said spine of said folder, which forms said holder adapted to receive either hand of a user.

Defined more broadly, the present invention is a holder for a book type article having a spine, comprising: (a) an elastic band covered by an absorbent material and having an interior opening to receive fingers of a hand; and (b) means for attaching said absorbent material to said spine of said book type article; (c) whereby said absorbent material can be attached to said spine of said book type article to form said holder.

Alternatively defined in detail, the present invention is a book cover with a removably attachable holder, comprising: (a) a book cover having a stiff spine with an exterior surface and interior surface; (b) an elongated female fastener having a loop type mating surface; (c) means for attaching said elongated female fastener to said exterior surface of said stiff spine and having said loop type mating surface facing away from said exterior surface of said stiff spine; (d) an elastic band which has an outer surface and having an interior opening to receive fingers of a hand; (e) an elongated male fastener having a complementary hook type mating surface for mating with said loop type mating surface of said elongated female fastener; and (f) means for attaching said elongated male fastener to said outer surface of said elastic band and having said hook type mating surface facing away from said outer surface of said elastic band; (g) whereby said complementary hook type mating surface of said elongated male fastener can be affixed to said loop type mating surface of said elongated female fastener to removably attach to said elastic band to said stiff spine of said book cover, which forms said holder adapted to receive either hand of a user.

Also defined alternatively in detail, the present invention is a book cover with a removably attachable holder, comprising: (a) a book cover having a stiff spine with an exterior surface and interior surface; (b) an elongated female fastener having a loop type mating surface; (c) means for attaching said elongated female fastener to said exterior surface of said stiff spine and having said loop type mating surface facing away from said exterior surface of said stiff spine; (d) an absorbent material which has an outer surface and having an interior opening to receive fingers of a hand; (e) an elongated male fastener having a complementary hook type mating surface for mating with said loop type mating surface of said elongated female fastener; and (f) means for attaching said elongated male fastener to said outer surface of said absorbent material and having said hook type mating surface facing away from said outer surface of said absorbent material; (g) whereby said complementary hook type mating surface of said elongated male fastener can be affixed to said loop type mating surface of said elongated female fastener to removably attach to said absorbent material to said stiff spine of said book cover, which forms said holder adapted to receive either hand of a user.

Further defined alternatively in detail, the present invention is a book cover with a removably attachable holder, comprising: (a) a book cover having a stiff spine with an exterior surface and interior surface; (b) an elongated female fastener having a loop type mating surface; (c) means for attaching said elongated female fastener to said exterior surface of said stiff spine and having said loop type mating surface facing away from said exterior surface of said stiff spine; (d) an elasticized material having two ends which has a first end and a second end; (e) said elasticized material having an interior opening to receive fingers of a hand; (f) an elongated male fastener having a complementary hook type mating surface for mating with said loop type mating surface of said elongated female fastener; and (g) a first end of said elongated male fastener attached to said first end of said elasticized material and a second end of said elongated attached to said second end of said elasticized material; (h) whereby said complementary hook type mating surface of said elongated male fastener can be affixed to said loop type mating surface of said elongated female fastener to removably attach to said elasticized material to said stiff spine of said book cover, which forms said holder adapted to receive either hand of a user.

Alternatively defined broadly, the present invention is a holder for a book cover having a spine, comprising: (a) a member having an interior opening to receive fingers of a hand; and (b) means for attaching said member to said spine of said book cover; (c) whereby said member can be attached to said spine of said book cover to form said holder.

The present invention is also defined as a holder for a folder having a spine with an exterior surface, comprising: (a) a first elongated fastener having a mating surface; (b) means for attaching said first elongated fastener to said exterior surface of said spine and having said mating surface facing away from said exterior surface of said spine; (c) an elastic band having an outer surface and an interior opening to receive fingers of a hand; (d) a second elongated fastener having a complementary mating surface for mating with said mating surface of said first elongated fastener; and (e) means for attaching said second elongated fastener to said outer surface of said elastic band and having said mating surface facing away from said outer surface of said elastic band; (f) whereby said complementary mating surface of said elongated fastener can be affixed to said mating surface of said first elongated fastener to removably attach said elastic band to said spine of said folder, which forms said holder adapted to receive either hand of a user.

The present invention is also defined as a holder for a folder having a spine with an exterior surface, comprising: (a) a first elongated fastener having a mating surface; (b) means for attaching said first elongated fastener to said exterior surface of said spine and having said mating surface facing away from said exterior surface of said spine; (c) a generally C-shaped elastic material having an outer surface and an interior opening to receive fingers of a hand; (d) a second elongated fastener having a complementary mating surface for mating with said mating surface of said first elongated fastener; and (e) means for attaching a respective one end of said second elongated fastener to a respective one of the open ends of said C-shaped elastic material and having said mating surface facing away from said outer surface of said elastic band; (f) whereby said complementary mating surface of said elongated fastener can be affixed to said mating surface of said first elongated fastener to removably attach said elastic band to said spine of said folder, which forms said holder adapted to receive either hand of a user.

The present invention is also defined as a holder for a folder having a spine with an exterior surface, comprising: (a) a first elongated fastener having a mating surface; (b) means for attaching said first elongated fastener to said exterior surface of said spine and having said mating surface facing away from said exterior surface of said spine; (c) an elastic absorbent material having an outer surface and an interior opening to receive fingers of a hand; (d) a second elongated fastener having a complementary mating surface for mating with said mating surface of said first elongated fastener; and (e) means for attaching said elongated fastener to said outer surface of said elastic absorbent material and having said mating surface facing away from said outer surface of said elastic band; (f) whereby said complementary mating surface of said elongated fastener can be affixed to said mating surface of said first elongated fastener to removably attach said elastic band to said spine of said folder, which forms said holder adapted to receive either hand of a user.

The present invention is also defined as a holder for a book cover having a spine with an exterior surface, comprising: (a) a first elongated fastener having a mating surface; (b) means for attaching said first elongated fastener to said exterior surface of said spine and having said mating surface facing away from said exterior surface of said spine; (c) an elastic band covered in an absorbent material which has an outer surface; (d) said elastic band having an interior opening to receive fingers of a hand; (e) a second elongated fastener having a complementary mating surface for mating with said mating surface of said first elongated fastener; and (f) means for attaching said second elongated fastener to said outer surface of said absorbent material and having said mating surface facing away from said outer surface of said absorbent material; (g) whereby said complementary mating surface of said elongated fastener can be affixed to said mating surface of said first elongated fastener to removably attach said elastic band covered in an absorbent material to said spine of said book cover, which forms said holder adapted to receive either hand of a user.

The present invention is also defined as a holder for a book cover having a spine with an exterior surface, comprising: (a) a first elongated fastener having a mating surface; (b) means for attaching said first elongated fastener to said exterior surface of said spine and having said mating surface facing away from said exterior surface of said spine; (c) an elastic band having an outer surface and an interior opening to receive fingers of a hand; (d) a second elongated fastener having a complementary mating surface for mating with said mating surface of said first elongated fastener; and (e) means for attaching said second elongated fastener to said outer surface of said elastic band and having said mating surface facing away from said outer surface of said elastic band; (f) whereby said complementary mating surface of said elongated fastener can be affixed to said mating surface of said first elongated fastener to removably attach said elastic band to said spine of said book cover, which forms said holder adapted to receive either hand of a user.

The present invention is also defined as a holder for a book cover having a spine with an exterior surface, comprising: (a) a first elongated fastener having a mating surface; (b) means for attaching said first elongated fastener to said exterior surface of said spine and having said mating surface facing away from said exterior surface of said spine; (c) a generally C-shaped elastic material having an outer surface and an interior opening to receive fingers of a hand; (d) a second elongated fastener having a complementary mating surface for mating with said mating surface of said first elongated fastener; and (e) means for attaching a respective one end of said second elongated fastener to a respective one of the open ends of said C-shaped elastic material and having said mating surface facing away from said outer surface of said elastic band; (f) whereby said complementary mating surface of said elongated fastener can be affixed to said mating surface of said first elongated fastener to removably attach said elastic band to said spine of said book cover, which forms said holder adapted to receive either hand of a user.

The present invention is also defined as a holder for a book cover having a spine with an exterior surface, comprising: (a) a first elongated fastener having a mating surface; (b) means for attaching said first elongated fastener to said exterior surface of said spine and having said mating surface facing away from said exterior surface of said spine; (c) an elastic absorbent material having an outer surface and an interior opening to receive fingers of a hand; (d) a second elongated fastener having a complementary mating surface for mating with said mating surface of said first elongated fastener; and (e) means for attaching said elongated fastener to said outer surface of said elastic absorbent material and having said mating surface facing away from said outer surface of said elastic absorbent material; (f) whereby said complementary mating surface of said elongated fastener can be affixed to said mating surface of said first elongated fastener to removably attach said elastic absorbent material to said spine of said book cover, which forms said holder adapted to receive either hand of a user.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A folder with a removably attachable holder, comprising:

a. a folder having a spine with an exterior surface and interior surface;

b. an elongated female fastener having a loop type mating surface;

c. means for attaching said elongated female fastener to said exterior surface of said spine and having said loop type mating surface facing away from said exterior surface of said spine;

d. an elastic band covered in a terry cloth which has an outer surface;

e. said elastic band having an interior opening to receive fingers of a hand;

f. an elongated male fastener having a complementary hook type mating surface for mating with said loop type mating surface of said elongated female fastener; and g. means for attaching said elongated male fastener to said outer surface of said terry cloth and having said hook type mating surface facing away from said outer surface of said terry cloth;

h. whereby said complementary hook type mating surface of said elongated male fastener can be affixed to said loop type mating surface of said elongated female fastener to removably attach to said terry cloth to said spine of said folder, which forms said holder adapted to receive either hand of a user.

2. The invention as defined in claim 1 wherein said means for attaching said elongated female fastener to said exterior surface of said spine is adhesive means.

3. The invention as defined in claim 1 wherein said means for attaching said elongated male fastener to said outer surface of said terry cloth is stitching means.

4. The invention as defined in claim 1 wherein said elastic band is made of rubber.

5. The invention as defined in claim 1 wherein said elongated male and female fasteners are generally rectangular shaped.

6. A holder for a folder having a spine with an exterior surface, comprising:

a. a first elongated fastener having a mating surface;

b. means for attaching said first elongated fastener to said exterior surface of said spine and having said mating surface facing away from said exterior surface of said spine;

c. an elastic band covered by an absorbent material which has an outer surface;

d. said elastic band having an interior opening to receive fingers of a hand;

e. a second elongated fastener having a complementary mating surface for mating with said mating surface of said first elongated fastener; and f. means for attaching said second elongated fastener to said outer surface of said absorbent material and having said mating surface facing away from said outer surface of said absorbent material;

g. whereby said complementary mating surface of said second elongated fastener can be affixed to said mating surface of said first elongated fastener to removably attach to said absorbent material to said spine of said folder, which forms said holder adapted to receive either hand of a user.

7. The invention as defined in claim 6 wherein said means for attaching said first elongated fastener to said exterior surface of said spine is adhesive means.

8. The invention as defined in claim 6 wherein said means for attaching said second elongated fastener to said outer surface of said absorbent material is stitching means.

9. The invention as defined in claim 6 wherein said elastic band is made of rubber.

10. The invention as defined in claim 6 wherein said first and second elongated fasteners are generally rectangular shaped.

11. The invention as defined in claim 6 wherein said mating surface of said first elongated fastener is a loop type surface.

12. The invention as defined in claim 11 wherein said complementary mating surface of said second elongated fastener is a hook type surface.

13. The invention as defined in claim 6 wherein said mating surface of said first elongated fastener is a hook type surface.

14. The invention as defined in claim 13 wherein said complementary mating surface of said second elongated fastener is a loop type surface.

15. The invention as defined in claim 6 wherein said absorbent material is terry cloth.

16. A holder for a book type article having a spine, comprising:

a. an elastic band covered by an absorbent material and having an interior opening to receive fingers of a hand; and b. means for attaching said absorbent material to said spine of said book type article;

c. whereby said absorbent material can be attached to said spine of said book type article to form said holder.

17. The invention as defined in claim 16 wherein said means for attaching said absorbent material of said elastic band to said spine of said book type article is a double sided fastener having one side attachable to said spine of said book type article and an opposite side attachable to said absorbent material of said elastic band.

18. The invention as defined in claim 16 wherein said means for attaching said absorbent material of said elastic band to said spine of said book type article includes a male fastener and a female fastener with complementary mating surfaces, where one of the male and female fasteners is attached to said spine of said book type article, and the other one of the male and female fasteners is attached to said absorbent material of said elastic band.

19. The invention as defined in claim 16 wherein said elastic band is made of rubber.

20. The invention as defined in claim 16 wherein said absorbent material is terry cloth.

21. The invention as defined in claim 16 wherein said book type article is a folder with a stiff spine.

22. A holder for a folder having a spine with an exterior surface, comprising:

a. a first elongated fastener having a mating surface;

b. means for attaching said first elongated fastener to said exterior surface of said spine and having said mating surface facing away from said exterior surface of said spine;

c. an elastic band having an outer surface and an interior opening to receive fingers of a hand;

d. a second elongated fastener having a complementary mating surface for mating with said mating surface of said first elongated fastener; and e. means for attaching said second elongated fastener to said outer surface of said elastic band and having said mating surface facing away from said outer surface of said elastic band;

f. whereby said complementary mating surface of said elongated fastener can be affixed to said mating surface of said first elongated fastener to removably attach said elastic band to said spine of said folder, which forms said holder adapted to receive either hand of a user.

23. The invention as defined in claim 22 wherein said means for attaching said first elongated fastener to said exterior surface of said spine is adhesive means.

24. The invention as defined in claim 22 wherein said means for attaching said second elongated fastener to said outer surface of said elastic band is stitching means.

25. The invention as defined in claim 22 wherein said mating surface of said first elongated fastener is a loop type surface.

26. The invention as defined in claim 25 wherein said complementary mating surface of said second elongated fastener is a hook type surface.

27. The invention as defined in claim 22 wherein said mating surface of said first elongated fastener is a hook type surface.

28. The invention as defined in claim 27 wherein said complementary mating surface of said second elongated fastener is a loop type surface.

29. A holder for a folder having a spine with an exterior surface, comprising:

a. a first elongated fastener having a mating surface;

b. means for attaching said first elongated fastener to said exterior surface of said spine and having said mating surface facing away from said exterior surface of said spine;

c. a generally C-shaped elastic material having an outer surface and an interior opening to receive fingers of a hand;

d. a second elongated fastener having a complementary mating surface for mating with said mating surface of said first elongated fastener; and e. means for attaching a respective one end of said second elongated fastener to a respective one of the open ends of said C-shaped elastic material and having said mating surface facing away from said outer surface of said elastic band;

f. whereby said complementary mating surface of said elongated fastener can be affixed to said mating surface of said first elongated fastener to removably attach said elastic band to said spine of said folder, which forms said holder adapted to receive either hand of a user.

30. The invention as defined in claim 29 wherein said means for attaching said first elongated fastener to said exterior surface of said spine is adhesive means.

31. The invention as defined in claim 29 wherein said means for attaching a respective one end of said second elongated fastener to a respective one of the open ends of said C-shaped elastic material is stitching means.

32. The invention as defined in claim 29 wherein said mating surface of said first elongated fastener is a loop type surface.

33. The invention as defined in claim 32 wherein said complementary mating surface of said second elongated fastener is a hook type surface.

34. The invention as defined in claim 29 wherein said mating surface of said first elongated fastener is a hook type surface.

35. The invention as defined in claim 34 wherein said complementary mating surface of said second elongated fastener is a loop type surface.

36. A holder for a folder having a spine with an exterior surface, comprising:

a. a first elongated fastener having a mating surface;

b. means for attaching said first elongated fastener to said exterior surface of said spine and having said mating surface facing away from said exterior surface of said spine;

c. an elastic absorbent material having an outer surface and an interior opening to receive fingers of a hand;

d. a second elongated fastener having a complementary mating surface for mating with said mating surface of said first elongated fastener; and e. means for attaching said elongated fastener to said outer surface of said elastic absorbent material and having said mating surface facing away from said outer surface of said elastic band;

f. whereby said complementary mating surface of said elongated fastener can be affixed to said mating surface of said first elongated fastener to removably attach said elastic band to said spine of said folder, which forms said holder adapted to receive either hand of a user.

37. The invention as defined in claim 36 wherein said means for attaching said first elongated fastener to said exterior surface of said spine is adhesive means.

38. The invention as defined in claim 36 wherein said means for attaching said second elongated fastener to said outer surface of said elastic absorbent material is stitching means.

39. The invention as defined in claim 36 wherein said mating surface of said first elongated fastener is a loop type surface.

40. The invention as defined in claim 39 wherein said complementary mating surface of said second elongated fastener is a hook type surface.

41. The invention as defined in claim 36 wherein said mating surface of said first elongated fastener is a hook type surface.

42. The invention as defined in claim 41 wherein said complementary mating surface of said second elongated fastener is a loop type surface.

43. A holder for a book cover having a spine with an exterior surface, comprising:

a. a first elongated fastener having a mating surface;

b. means for attaching said first elongated fastener to said exterior surface of said spine and having said mating surface facing away from said exterior surface of said spine;

c. an elastic band covered in an absorbent material which has an outer surface;

d. said elastic band having an interior opening to receive fingers of a hand;

e. a second elongated fastener having a complementary mating surface for mating with said mating surface of said first elongated fastener; and f. means for attaching said second elongated fastener to said outer surface of said absorbent material and having said mating surface facing away from said outer surface of said absorbent material;

g. whereby said complementary mating surface of said elongated fastener can be affixed to said mating surface of said first elongated fastener to removably attach said elastic band covered in an absorbent material to said spine of said book cover, which forms said holder adapted to receive either hand of a user.

44. The invention as defined in claim 43 wherein said means for attaching said first elongated fastener to said exterior surface of said spine is adhesive means.

45. The invention as defined in claim 43 wherein said means for attaching said second elongated fastener to said outer surface of said absorbent material is stitching means.

46. The invention as defined in claim 43 wherein said mating surface of said first elongated fastener is a loop type surface.

47. The invention as defined in claim 46 wherein said complementary mating surface of said second elongated fastener is a hook type surface.

48. The invention as defined in claim 43 wherein said mating surface of said first elongated fastener is a hook type surface.

49. The invention as defined in claim 48 wherein said complementary mating surface of said second elongated fastener is a loop type surface.

50. The invention as defined in claim 43 wherein said absorbent material is terry cloth.

51. A holder for a book cover having a spine with an exterior surface, comprising:

a. a first elongated fastener having a mating surface;

b. means for attaching said first elongated fastener to said exterior surface of said spine and having said mating surface facing away from said exterior surface of said spine;

c. an elastic band having an outer surface and an interior opening to receive fingers of a hand;

d. a second elongated fastener having a complementary mating surface for mating with said mating surface of said first elongated fastener; and e. means for attaching said second elongated fastener to said outer surface of said elastic band and having said mating surface facing away from said outer surface of said elastic band;

f. whereby said complementary mating surface of said elongated fastener can be affixed to said mating surface of said first elongated fastener to removably attach said elastic band to said spine of said book cover, which forms said holder adapted to receive either hand of a user.

52. The invention as defined in claim 51 wherein said means for attaching said first elongated fastener to said exterior surface of said spine is adhesive means.

53. The invention as defined in claim 51 wherein said means for attaching said second elongated fastener to said outer surface of said absorbent material is stitching means.

54. The invention as defined in claim 51 wherein said mating surface of said first elongated fastener is a loop type surface.

55. The invention as defined in claim 54 wherein said complementary mating surface of said second elongated fastener is a hook type surface.

56. The invention as defined in claim 51 wherein said mating surface of said first elongated fastener is a hook type surface.

57. The invention as defined in claim 56 wherein said complementary mating surface of said second elongated fastener is a loop type surface.

58. A holder for a book cover having a spine with an exterior surface, comprising:

a. a first elongated fastener having a mating surface;

b. means for attaching said first elongated fastener to said exterior surface of said spine and having said mating surface facing away from said exterior surface of said spine;

c. a generally C-shaped elastic material having an outer surface and an interior opening to receive fingers of a hand;

d. a second elongated fastener having a complementary mating surface for mating with said mating surface of said first elongated fastener; and e. means for attaching a respective one end of said second elongated fastener to a respective one of the open ends of said C-shaped elastic material and having said mating surface facing away from said outer surface of said C-shaped elastic material;

f. whereby said complementary mating surface of said second elongated fastener can be affixed to said mating surface of said first elongated fastener to removably attach said C-shaped elastic material to said spine of said book cover, which forms said holder adapted to receive either hand of a user.

59. The invention as defined in claim 58 wherein said means for attaching said first elongated fastener to said exterior surface of said spine is adhesive means.

60. The invention as defined in claim 58 wherein said means for attaching said respective one end of said second elongated fastener to said respective one of the open ends of said C-shaped elastic material is stitching means.

61. The invention as defined in claim 58 wherein said mating surface of said first elongated fastener is a loop type surface.

62. The invention as defined in claim 61 wherein said complementary mating surface of said second elongated fastener is a hook type surface.

63. The invention as defined in claim 58 wherein said mating surface of said first elongated fastener is a hook type surface.

64. The invention as defined in claim 63 wherein said complementary mating surface of said second elongated fastener is a loop type surface.

65. A holder for a book cover having a spine with an exterior surface, comprising:

a. a first elongated fastener having a mating surface;

b. means for attaching said first elongated fastener to said exterior surface of said spine and having said mating surface facing away from said exterior surface of said spine;

c. an elastic absorbent material having an outer surface and an interior opening to receive fingers of a hand;

d. a second elongated fastener having a complementary mating surface for mating with said mating surface of said first elongated fastener; and e. means for attaching said second elongated fastener to said outer surface of said elastic absorbent material and having said complementary mating surface facing away from said outer surface of said elastic absorbent material;

f. whereby said complementary mating surface of said second elongated fastener can be affixed to said mating surface of said first elongated fastener to removably attach said elastic absorbent material to said spine of said book cover, which forms said holder adapted to receive either hand of a user.

66. The invention as defined in claim 65 wherein said means for attaching said first elongated fastener to said exterior surface of said spine is adhesive means.

67. The invention as defined in claim 65 wherein said means for attaching said second elongated fastener to said outer surface of said elastic absorbent material is stitching means.

68. The invention as defined in claim 65 wherein said mating surface of said first elongated fastener is a loop type surface.

69. The invention as defined in claim 68 wherein said complementary mating surface of said second elongated fastener is a hook type surface.

70. The invention as defined in claim 65 wherein said mating surface of said first elongated fastener is a hook type surface.

71. The invention as defined in claim 70 wherein said complementary mating surface of said second elongated fastener is a loop type surface.

72. A holder for a book cover having a spine, comprising:

a. a member having an interior opening to receive fingers of a hand; and b. a double sided fastener having one side attachable to said spine of said book cover and an opposite side attachable to said member;

c. whereby said member can be attached to said spine of said book cover to form said holder.

73. The invention as defined in claim 71 wherein said member is an elastic band.

74. The invention as defined in claim 71 wherein said member is an absorbent material.

75. The invention as defined in claim 72 wherein said member is an elasticized material.

76. The invention as defined in claim 75 wherein said elasticized material is generally "C" shaped.

* * * * *